US006457911B1

(12) United States Patent
Scales et al.

(10) Patent No.: US 6,457,911 B1
(45) **Date of Patent: *Oct. 1, 2002**

(54) BLOCKS AND CONNECTOR FOR MECHANICALLY-STABILIZED EARTH RETAINING WALL HAVING SOIL-REINFORCING SHEETS

(75) Inventors: John M. Scales, Norcross; Zehong Yuan Pe, Duluth, both of GA (US)

(73) Assignee: Geostar Corporation, Norcross, GA (US)

( * ) Notice: Subject to any disclaimer, the term of this patent is extended or adjusted under 35 U.S.C. 154(b) by 0 days.

This patent is subject to a terminal disclaimer.

(21) Appl. No.: 09/703,990

(22) Filed: Oct. 25, 2000

(51) Int. Cl.[7] ..... E02D 29/02
(52) U.S. Cl. ..... 405/262; 405/284; 405/286
(58) Field of Search ..... 405/262, 284, 405/285, 286

(56) References Cited

U.S. PATENT DOCUMENTS

| | | | | |
|---|---|---|---|---|
| 3,383,864 A | | 5/1968 | Turzillo | 61/38 |
| 3,686,873 A | | 8/1972 | Vidal | 61/39 |
| 4,116,010 A | | 9/1978 | Vidal | 405/262 |
| 4,324,508 A | | 4/1982 | Hilfiker et al. | 405/284 |
| 4,448,571 A | | 5/1984 | Eckels | 405/284 |
| 4,661,023 A | | 4/1987 | Hilfiker | 405/262 |
| 4,710,062 A | | 12/1987 | Vidal et al. | 405/262 |
| 4,804,299 A | | 2/1989 | Forte et al. | 405/285 |
| 4,824,293 A | | 4/1989 | Brown et al. | 405/284 |
| 4,914,876 A | | 4/1990 | Forsberg | 52/169.4 |
| 5,028,172 A | | 7/1991 | Wilson et al. | 405/286 |
| 5,033,912 A | | 7/1991 | Vidal | 405/262 |
| 5,091,247 A | | 2/1992 | Willibey et al. | 428/255 |
| 5,131,791 A | | 7/1992 | Kitziller | 405/286 |
| 5,145,288 A | | 9/1992 | Borcherdt | 405/284 |
| 5,156,496 A | | 10/1992 | Vidal et al. | 405/262 |
| 5,163,261 A | | 11/1992 | O'Neill | 52/610 |
| 5,277,520 A | | 1/1994 | Travis | 405/128 |
| 5,417,523 A | | 5/1995 | Scales | 405/284 |
| 5,419,092 A | | 5/1995 | Jaecklin | 52/562 |
| 5,511,910 A | * | 4/1996 | Scales | 405/262 |
| 5,595,460 A | | 1/1997 | Miller et al. | 405/284 |
| 5,607,262 A | * | 3/1997 | Martin | 405/284 |
| 5,788,420 A | | 8/1998 | Scales | 405/262 |

(List continued on next page.)

OTHER PUBLICATIONS

Designing with Geosynthetics, Koerner, Robert M., Prentice–Hall, Inc., Englewood Cliffs, NJ 07632, 3rd ed.—p. 37–42;192–199;328–351.
Safe slope reinforcement and stable embankment construction (undated).

*Primary Examiner*—Heather Shackelford
*Assistant Examiner*—Frederick L. Lagman
(74) *Attorney, Agent, or Firm*—Baker, Donelson, Bearman & Caldwell

(57) ABSTRACT

An earth retaining wall made of stacked tiers of blocks placed side by side to form a wall with a channel extending at least partially along a longitudinal axis of the wall in which the channel is defined at least two adjacent bearing surfaces of vertically adjacent blocks and a pathway extending from the channel to an exterior side of the wall. The channel receives an elongate clamping bar that conforms in cross-sectional shape at least relative to the bearing surfaces. A reinforcement sheet wrapped around the elongate connector bar extends through the pathway laterally of the wall. The clamping bar communicates tensile loading of backfill on the reinforcement sheet to the wall. The wall is mechanically stabilized by normal loading from the blocks in the wall above a reinforcement sheet and the tensile loading of the backfill communicated by the clamping bar to the wall. A method of constructing an earth retaining wall and blocks useful in such wall are disclosed.

62 Claims, 5 Drawing Sheets

U.S. PATENT DOCUMENTS 5,800,095 A 9/1998 Egan ..... 405/262
5,800,097 A * 9/1998 Martin ..... 405/284
5,816,749 A 10/1998 Bailey, II ..... 405/286
5,839,855 A * 11/1998 Anderson et al. ..... 405/262
5,934,838 A * 8/1999 Egan ..... 405/262
5,975,809 A * 11/1999 Taylor et al. ..... 405/262
6,019,550 A 2/2000 Wrigley et al. ..... 405/252
6,224,295 B1 * 5/2001 Price et al. ..... 405/262

* cited by examiner

BLOCKS AND CONNECTOR FOR MECHANICALLY-STABILIZED EARTH RETAINING WALL HAVING SOIL-REINFORCING SHEETS

TECHNICAL FIELD

The present invention relates to earth retaining walls. More particularly, the present invention relates to mechanically stabilized earth retaining walls having laterally extending soil reinforcement sheets for connecting the wall to backfill.

BACKGROUND OF THE INVENTION

Mechanically stabilized earth retaining walls are construction devices used to reinforce earthen slopes, particularly where changes in elevations occur rapidly, for development sites with steeply sloped embankments. These embankments must be secured, such as by retaining walls, against collapse or failure to protect persons and property from possible injury or damage caused by the slippage or sliding of the earthen slope.

Many designs for earth retaining walls exist today. Wall designs must account for lateral earth and water pressures, the weight of the wall, temperature and shrinkage effects, and earthquake loads. The design type known as mechanically stabilized earth retaining walls employ either metallic or polymeric tensile reinforcements in the soil mass. The tensile reinforcements extend laterally of the wall formed of a plurality of modular facing units, typically precast concrete members, blocks or panels that stack together. The tensile reinforcements connect the soil mass to the blocks that define the wall. The blocks create a visual vertical facing for the reinforced soil mass.

The polymeric tensile reinforcements typically used are elongated lattice-like structures, often referred to as grids. These are stiff polymeric extrusions that define sheet-like structures. The grids have elongated ribs which connect to transversely aligned bars thereby forming elongated apertures between the ribs. As discussed below, other non-extruded tensile reinforcements have been developed.

Various connection methods are used during construction of earth retaining walls to interlock the blocks or panels with the grids. One known type of retaining wall has blocks with bores extending inwardly within the top and bottom surfaces. The bores receive dowels or pins. After a first tier of blocks has been positioned laterally along the length of the wall, the dowels are inserted into the bores of the upper surfaces of the blocks. Edge portions of the grids are placed on the tier of blocks so that each of the dowels extends through a respective one of the apertures. This connects the wall to the grid. The grid extends laterally from the blocks and is covered with back fill. A second tier of blocks is positioned with the upwardly extending dowels fitting within bores of the bottom surfaces of the blocks. The loading of backfill over the grids is distributed at the dowel-to-grid connection points. The strength of the grid-to-wall connection is generated by friction between the upper and lower block surfaces and the grid and by the linkage between the aggregate trapped by the wall and the apertures of the grid. The magnitude of these two contributing factors varies with the workmanship of the wall, normal stresses applied by the weight of the blocks above the connection, and by the quality and size of the aggregate.

Other connection devices are known. For example, my U.S. Pat. No. 5,417,523 describes a connector bar with spaced-apart keys that engage apertures in the grid that extends laterally from the wall. The connector bars are received in channels defined in the upper and lower surfaces of the blocks.

The specifications for earth retaining walls are based upon the strength of the interlocking components and the load created by the backfill. Once the desired wall height and type of ground conditions are known, the number of grids, the vertical spacing between adjacent grids, and lateral positioning of the grids is determined, dependent upon the load capacity of the interlocking components.

Heretofore, construction of such mechanically stabilized earth retaining walls has been limited to large walls involving significantly expensive projects. This is due in part to the cost of the mechanical components used for construction of such large earth retaining walls. To reduce costs, flexible tensile reinforcement sheets other than grids have been developed for use with mechanically stabilized earth retaining walls. These flexible tensile reinforcement sheets include large open-grid woven lattices and small-aperture woven lattices, as well as woven textile sheets. These other tensile reinforcements are significantly less expensive than extruded grids. However, when these other flexible reinforcements are used in construction of mechanically stabilized earth walls, their connection with the wall facing units has been a major technical challenge. Up to now, the flexible reinforcements are connected to the modular blocks through is the block-reinforcement friction. The magnitude of the frictional force, (i.e., connection strength) depends on the overburden pressure acting on the reinforcement under consideration. The higher the overburden pressure, the larger the connection strength. For small block walls, the normal stresses that are applied by the weight of blocks are limited and the required connection strength is often difficult to meet.

Accordingly, there is a need in the art for an earth retaining wall that is mechanically stabilized with normal stress by the mass of the blocks in the wall and supplemental loading by connectors transferring tensile loading on reinforcement sheets that extend laterally from the wall into backfill material. It is to such that the present invention is directed.

BRIEF SUMMARY OF THE INVENTION

The present invention meets the need in the art by providing an earth retaining wall, comprising at least two stacked tiers of blocks placed side by side to form a wall with a channel extending at least partially along a longitudinal axis of the wall. The channel defines at least two adjacent bearing surfaces and a pathway that extends from the channel to an exterior side of the wall. The channel receives an elongate connector bar that conforms in cross-sectional shape at least relative to the bearing surfaces. A reinforcement sheet wraps around the connector bar and a portion extends through the pathway laterally of the wall. The connector bar, being wrapped by a portion of the reinforcement sheet and received in the channel with the reinforcement sheet extending laterally and a portion thereof loaded by backfill, mechanically engages the bearing surfaces of the channel to distribute the tensile loading to the block.

In another aspect, the present invention provides an earth retaining wall, comprising at least two stacked tiers of blocks placed side by side to form a wall with a channel extending at least partially along a longitudinal axis of the wall. The channel is defined by vertically opposing blocks in the tiers of blocks with respective top and bottom surfaces of adjacent blocks defining two bearing surfaces. The blocks closely nest together while leaving the pathway therebetween through which the reinforcement sheet extends. The channel receives an elongate connector bar that conforms in cross-sectional shape at least relative to the bearing surfaces. A reinforcement sheet wraps around the connector bar and a portion extends through the pathway laterally of the wall. The connector bar, being wrapped by a portion of the reinforcement sheet and received in the channel with the reinforcement sheet extending laterally and a portion thereof loaded by backfill, mechanically engages the bearing surfaces of the channel to distribute the tensile loading to the block.

In another aspect, the present invention provides a method of constructing an earth retaining wall, comprising the steps of:

(a) placing first and second tiers of blocks side by side to define a length of a wall with a channel extending at least partially along a longitudinal length thereof, the channel defining at least two bearing surfaces, and a pathway extending from the channel to an exterior side of the wall;

(b) wrapping a portion of a reinforcement sheet over a connector conforming in cross-sectional shape at least relative to the two bearing surfaces;

(c) positioning the connector and the reinforcement sheet within the channel with a portion of the reinforcement sheet extending along the pathway laterally of the wall;

(d) covering the portion of the reinforcement sheet lateral of the wall with backfill, whereby the connector, being wrapped by the reinforcement sheet loaded by backfill, mechanically engages the two bearing surfaces of the channel such that the tensile loading is distributed to the block.

In another aspect, the present invention provides a block for constructing an earth retaining wall formed of a plurality of the blocks placed side-by-side in tiers. Each block defines two opposing sides, a top and an opposing bottom, and a front face and an opposing back face. The top of the block defines an open recess having opposed tapering sides extending to a base of the recess. The bottom of the block defines a projection extending away from the body with opposed tapering sides. The depth of the channel exceeds the length of the projection from the block. The recess of one such block receives the projection of another such block, thereby defining a channel through two aligned blocks for receiving a clamping bar therein. One of the opposing walls in the recess and a bottom wall of the bottom face define bearing surfaces for engaging surfaces of the clamping bar. The adjacent blocks define an pathway that extends from the channel outwardly of the blocks for receiving therein a portion of a reinforcement sheet. The blocks, receiving the clamping bar wrapped with a portion of the reinforcement sheet that extends through the pathway laterally of the blocks, bear loading from the backfill covering the reinforcement sheet communicated by the clamping bar against the bearing surfaces.

Objects, advantages and features of the present invention will become apparent from a reading of the following detailed description of the invention and claims in view of the appended drawings.

DETAILED DESCRIPTION OF THE PREFERRED EMBODIMENTS

Figure 1:
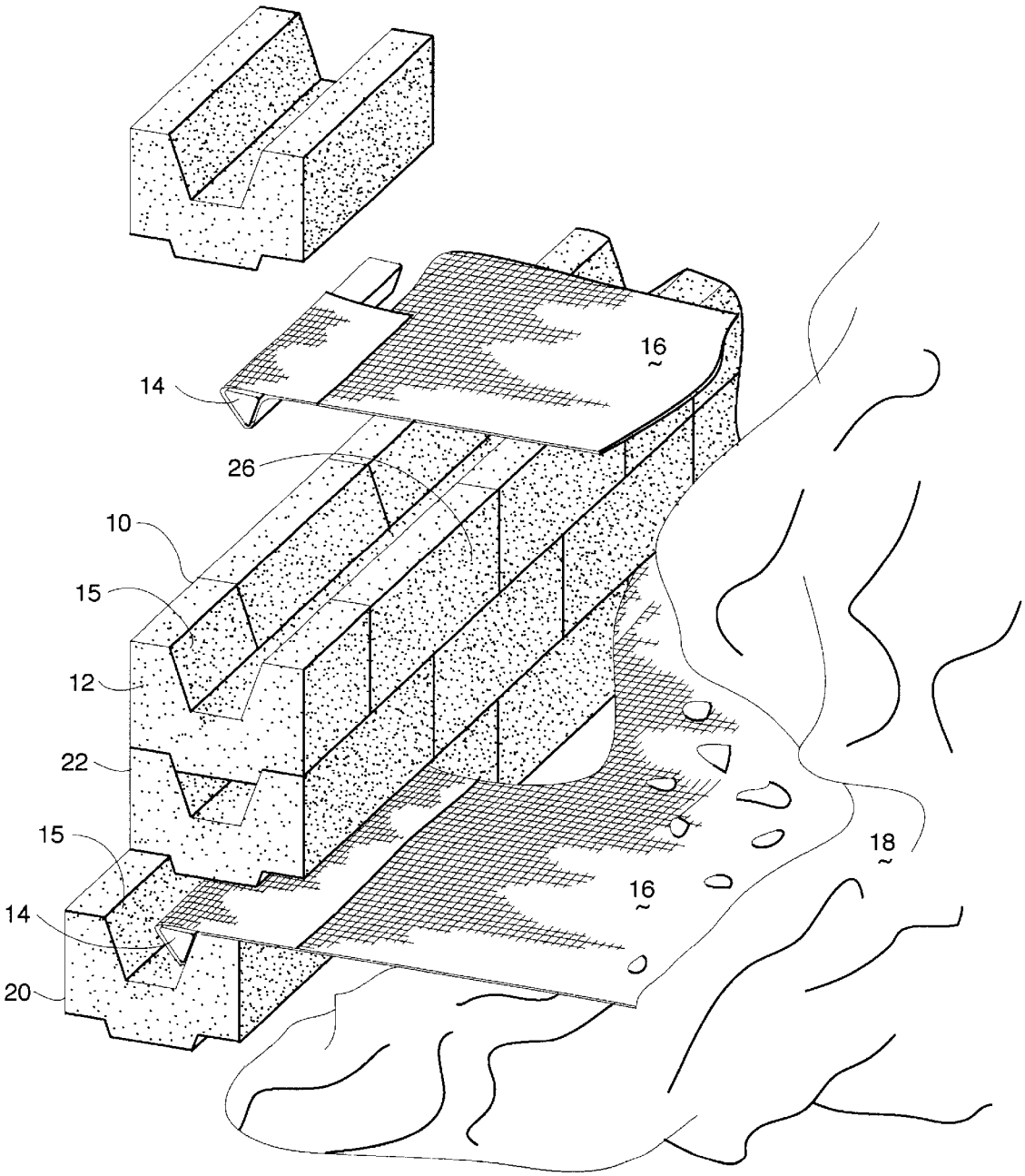
FIG. 1 illustrates a perspective cut-away view of an earth retaining wall according to the present invention.

Referring now in more detail to the drawings in which like parts have like identifiers, FIG. 1 is a perspective view of a mechanically stabilized earth retaining wall 10 according to the present invention. The wall 10 comprises a plurality of stacked, interconnected blocks 12 which receive connectors or clamping bars 14 that engage reinforcement sheets 16. As discussed below the clamping bars 14 extend through aligned channels 15 defined by the blocks 12. The reinforcement sheets 16 extend laterally of the wall 10 into backfill 18 at selected vertical intervals. The clamping bars 14 communicate the tensile loading from the backfill 18 on the reinforcement sheets 16 to the wall 10.

The wall 10 comprises at least two tiers 20, 22 of the blocks 12 from which the reinforcement sheets 16 extend laterally. The blocks 12 in each tier 20, 22 are placed side-by-side to form the elongated retaining wall 10 and to define the channels 15 as discussed below. Soil, gravel, or other backfill material 18 is placed on an interior side 26 of the wall 10.

Figure 2:
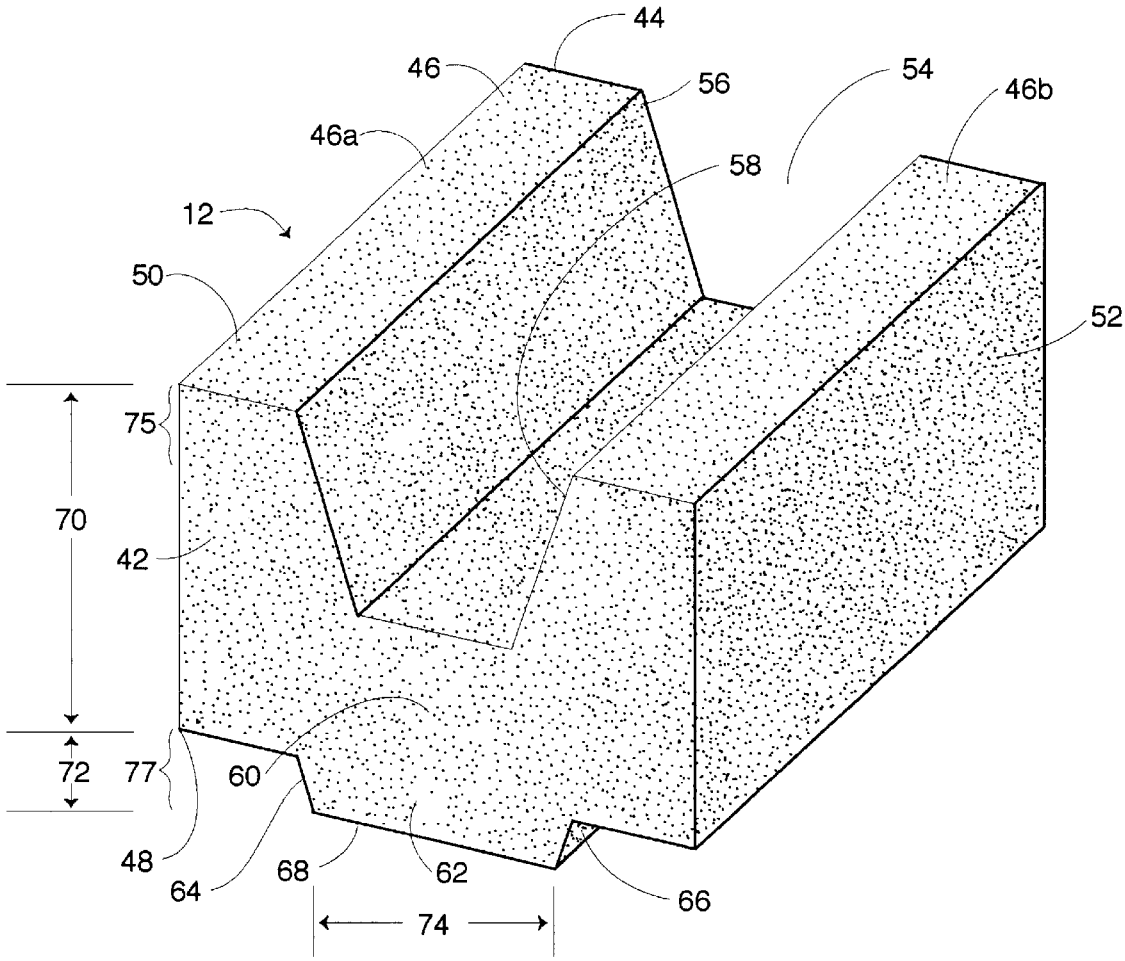
FIG. 2 illustrates in perspective view of a block according to the present invention for constructing an earth retaining wall as illustrated in FIG. 1.

FIG. 2 is a perspective view of a block 12 for constructing the earth retaining wall 10, formed of a plurality of the blocks 12 placed side-by-side in tiers. The block 12 comprises a body defined by two opposing sides 42, 44, a top 46 and an opposing bottom 48, and a front face 50 and an opposing back face 52. The top 46 of the block 12 defines an open recess 54 having opposed tapering sides 56, 58 that extend to a base 60 of the recess. The top 46 has two separated surfaces 46*a* and 46*b*. The surface 46*b* is recessed relative to the surface 46*a*, to accommodate the thickness of the reinforcement sheet 16. The bottom 48 of the block 12 defines an opposing projection 62 that extends away from the block with opposed tapering sides 64, 66. A surface 68 extends between the distal ends of the sides 64, 66. The depth 70 of the channel recess 54 exceeds the length 72 of the projection 62 outwardly from the body of the block 12. The width 74 of the wedge-shaped projection 62 is sized for being received within the recess 54 of a vertically dependent block, such as in a vertically adjacent tier, for a purpose discussed below.

Figure 7:
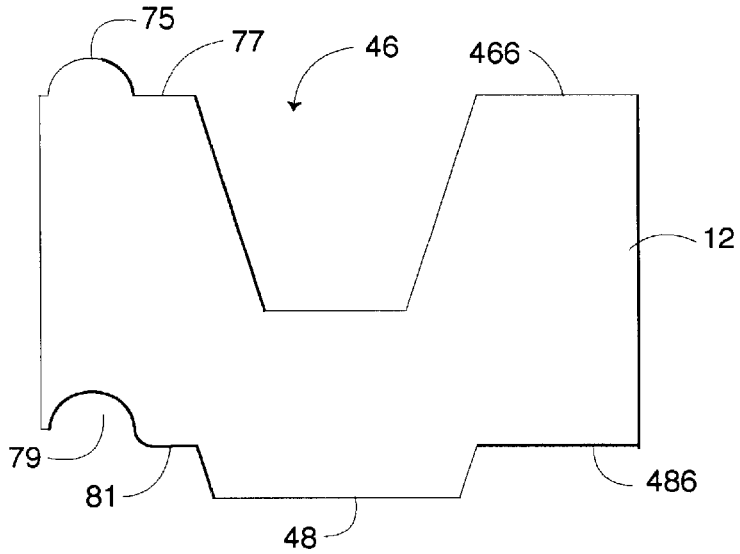
FIG. 7 illustrates an alternate embodiment of a block useful with the present invention.

The blocks 12 are preferably pre-cast concrete. As is conventional with blocks for earth retaining walls, the block 12 may include matingly conformable top and bottom surfaces 46, 48. In an embodiment illustrated in FIG. 7, the top surface 46 defines a raised portion 75 and a recessed portion 77. The opposing bottom 48 likewise defines a recess portion 79 and an extended portion 81. The recess portion 77 in the top 46 opposes the extended portion 81 in the bottom 48. The raised portion 75 opposes the recess portion 79. When blocks 12 are stacked in tiers 20, 22, the recessed portion 77 of blocks in the lower tier 20 receive the respective extended portion 81 of the blocks 12 in the upper tier 22. Similarly, the raised portions 75 in the lower tier 20 are received in the respective recesses 79 of the upper tier 22. In this way, the blocks 12 in vertically adjacent tiers 20, 22 are matingly engaged.

Figure 3:
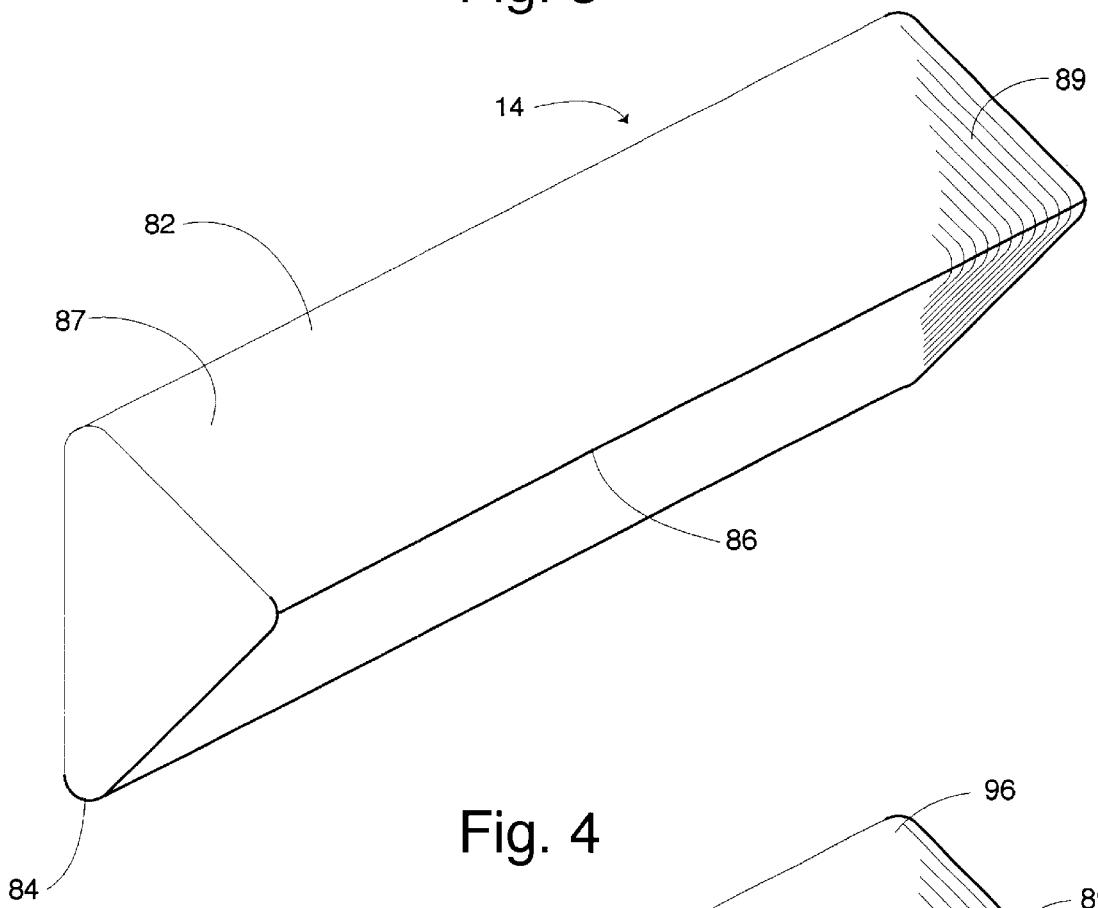
FIG. 3 illustrates in perspective view an embodiment of a connector bar for constructing an earth retaining wall illustrated in FIG. 1.

FIG. 3 is a perspective view of an embodiment of the clamping bar 14 according to the present invention. The clamping bar 14 is received in the channel 15 defined by a pair of the blocks 12, as discussed below. The clamping bar 14 communicates the tensile loading from the reinforcement sheet 16 to bearing surfaces in the blocks 12 that form the wall 10. In cross-sectional view, the clamping bar 14 defines a substantially triangular shape for conformingly being received within the channel 15. In a preferred embodiment, the clamping bar 14 defines an equilateral triangle to facilitate installation in the channels 15. The clamping bar 14 defines three apexes 82, 84, and 86. In the illustrated embodiment, the apexes 82, 84, and 86 define radiused apexes. For example, the clamping bar 14 in one embodiment has a length of twelve inches, and equilateral sides of approximately 1.5 inches reduced slightly to accommodate the apex radiuses of 0.1094 inches. In one embodiment, an exterior surface 87 of the clamping bar 14 has texturing generally 89, such as spaced-apart grooves and ridges, cross-hatching, roughened projections and recessed areas and the like, for a purpose discussed below. The clamping bar 14 is preferably formed of a high strength flexible material, such as rubber or plastic such as a flexible PVC.

Figure 4:
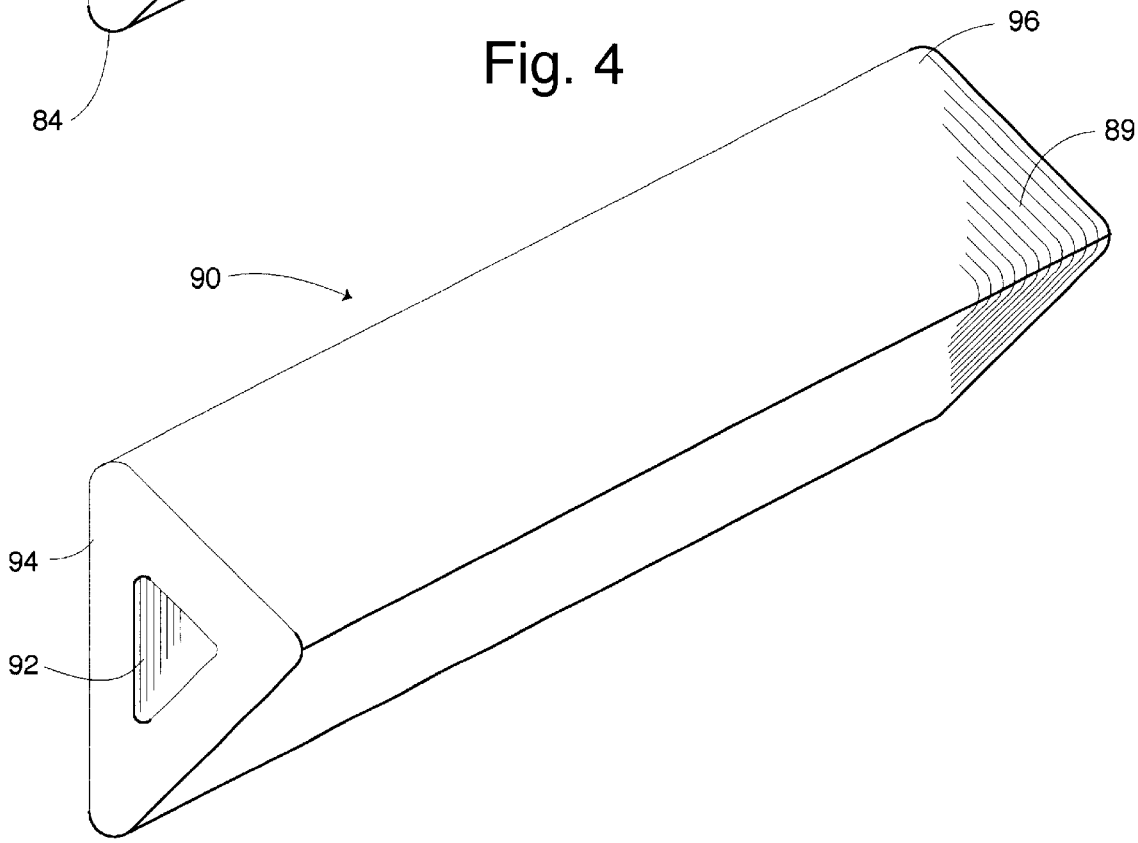
FIG. 4 illustrates in perspective view an alternate embodiment of a connector bar illustrated in FIG. 3.

FIG. 4 is a perspective view of an alternate embodiment 90 of a clamping bar of the present invention. In this embodiment, the clamping bar 90 defines a cavity 92 extending between opposing distal ends 94, 96 along a longitudinal axis. In the illustrated embodiment, the cavity 92 conforms in cross-sectional shape to the crosssectional shape of clamping bar 90.

Figure 5:
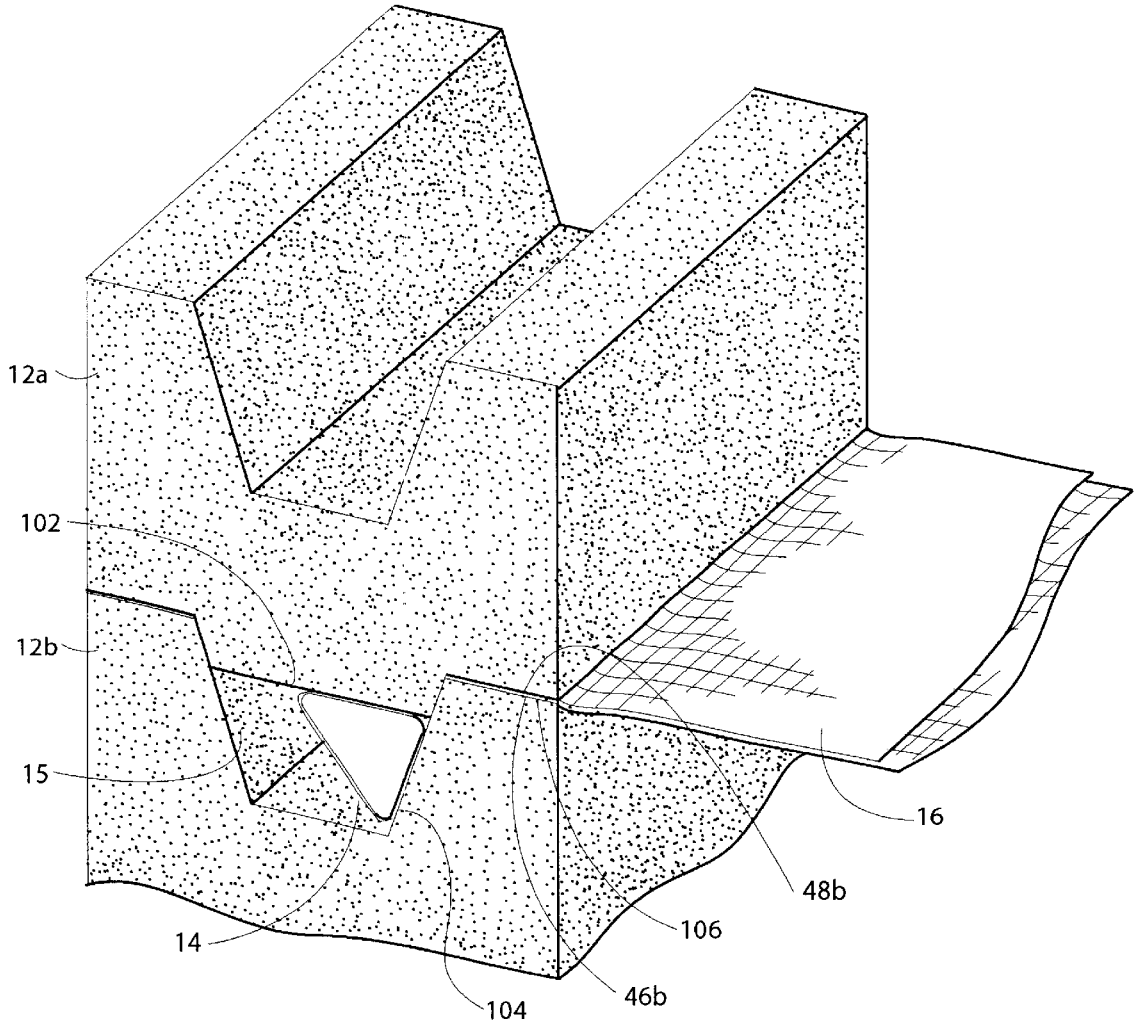
FIG. 5 illustrates in perspective view two blocks illustrated in FIG. 2 as a portion of two tiers of an earth retaining wall.

FIG. 5 illustrates in perspective view two blocks 12*a*, 12*b* illustrated in FIG. 2 as a portion of two tiers of an earth retaining wall. The two vertically adjacent blocks 12*a*, 12*b* thereby define the channel 15 in the wall 10 assembled with the blocks. The channel 15 defines two bearing surfaces 102, 104 for contacting exterior surfaces of the clamping bar 14 (or the alternate embodiment 90) as discussed below. The bearing surface 102 is defined by the bottom surface 68 of the projection 62 in the upper block 12*a*. The bearing surface 104 is defined by the tapered side 58 of the lower block 12*b*.

The adjacent blocks 12*a*, 12*b* define a pathway 106. The surfaces of the pathway 106 are defined by a lateral portion of the surface 46*b* of the block 12*b* and a lateral portion of the surface 48*b* of the block 12*a*. The pathway 106 extends from the channel 15 outwardly of the blocks 12*a*, 12*b* for receiving therein a portion of the reinforcement sheet 16.

Figure 6:
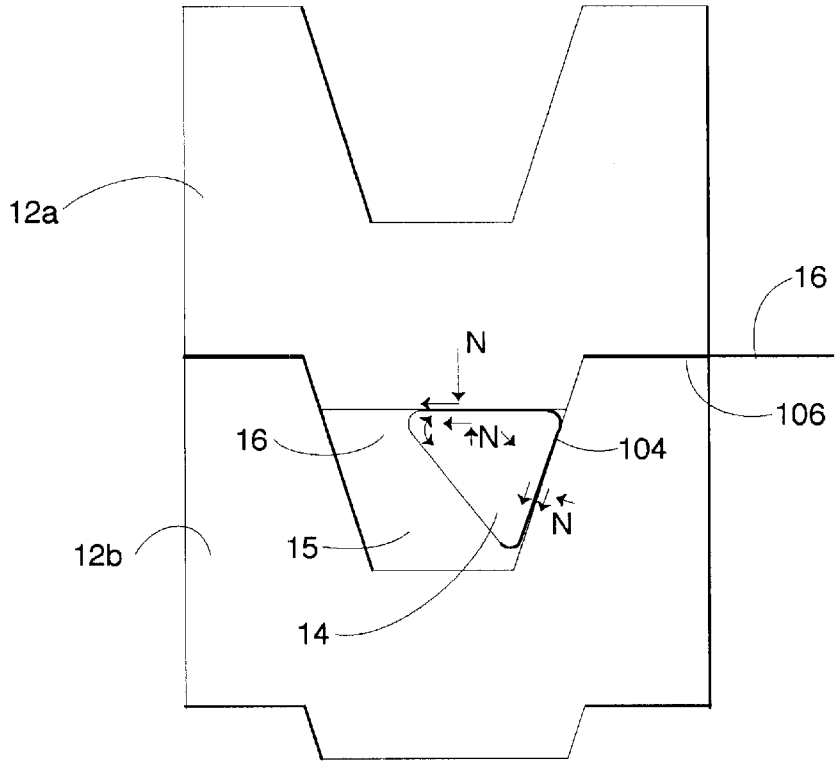
FIG. 6 illustrates a design concept for the present invention.

With reference to FIG. 6, a design for the mechanically stabilized wall 10 may be described as follows, where:

P is the pull-out loading for the reinforcement sheet 16, which equals the resisting force of the friction between the clamping bar 14 and the bearing surfaces 102, 104 in the blocks 12*a*, 12*b*.

N is the normal loading between the bearing surfaces 102, 104 and the clamping bar 14.

$\alpha$ is the angle between the normal load N and a perpendicular line to the reinforcement sheet 16.

$\phi$ is the friction angle at the planar interface between the reinforcement sheet 16 and the clamping bar 14. This angle controls the self-locking attribute of the apparatus of the present invention.

The present invention is described by the following equation:

$$P=2N \sin \alpha \quad \text{(Eq. 1)}$$

The mobilized peak pull-out resistance is represented by the frictional load between the reinforcement sheet 16 and the bearing surfaces 102, 104 of the channel 15 and between the reinforcement sheet 16 and the clamping bar 14. The tensile loading on the reinforcement sheet 16 accordingly is resisted by four surfaces of frictional loading. This is described by the following equation:

$$P=4N \tan \phi \quad \text{(Eq. 2)}$$

Combining equations one and two shows:

$$2N \sin \alpha=4N \tan \phi \quad \text{(Eq. 3)}$$

which reduces to $$\sin \alpha=2 \tan \phi \quad \text{(Eq. 4)}$$

Generally, higher values of the angle $\phi$ provide increased self-locking capability of the clamping bars 14.

For example, assume that $\alpha$ equals 30°. In order to have a reinforcement sheet 16 fully locked in the channel 15 between the blocks 12*a*, 12*b* by the clamping bar 14, $$\phi \geqq \text{arc tan (sin alpha/2), or arc tan (0.5/2).}$$

Accordingly, $\phi \geqq 14°$.

It is noted that the friction angle $\phi$ between the clamping bar 14 and the reinforcement sheet 16 is likely greater than the computed 140, thereby achieving the self-lock pull-out resistance of the present invention. In the event that sliding failure mode occurs, the angle of $\alpha$ can be reduced, and thus a smaller $\phi$ will meet the requirements for self-lock securing of the reinforcement sheet 16 to the blocks 12*a*, 12*b* by the clamping bar 14.

With reference to FIG. 1, the mechanically stabilized earth retaining wall 10 is assembled by placing a plurality of blocks 12 in the tier 20. A reinforcement sheet 16 is wrapped around one of the clamping bars 14. The clamping bar 14 with the wrapped reinforcement sheet 16 then is received in the recess 54. The reinforcement sheet 16 is extended laterally of the back face 52 of the blocks 12 in the tier 20. Preferably, the side portion of the reinforcement sheet is wrapped around the clamping bar such that a side edge extends outwardly of the block 12.

A second tier 22 of a plurality of blocks 12 is placed on the first tier 20. As illustrated in FIG. 5, the vertically adjacent blocks 12*a*, 12*b* cooperatively define the channel 15. The reinforcement sheet 16 is pulled laterally, to wedgingly engage the clamping bar towards the bearing surfaces 102, 104. Backfill 18 covers the laterally extending reinforcement sheet 16. The loading on the reinforcement sheet impels the clamping bar 14 to wedgingly engage the opening between the bearing surfaces 102, 104 of the channel 15. This locks the reinforcement sheet 16 in place together with the clamping bar 14.

Additional tiers 20, 22 of blocks 12 are placed in the wall with clamping bars 14 engaging reinforcement sheets 16 at selected vertical intervals. Backfill 18 is poured over the laterally extending reinforcement sheets 16 in order to load the clamping bars 14 into bearing engagement with the bearing surfaces 102, 104 of the blocks 12 in the wall. The clamping bars 14 distribute the tensile loading from the reinforcement sheets 16 to the blocks 12. Construction of the wall 10 continues until appropriate tiers and reinforcement sheets are connected together until the design height of the wall is reached.

While this invention has been described in detail with particular reference to the preferred embodiments thereof, the principles and modes of operation of the present invention have been described in the foregoing specification. The invention is not to be construed as limited to the particular forms disclosed because these are regarded as illustrative rather than restrictive. Moreover, modifications, variations and changes may be made by those skilled in the art without departure from the spirit and scope of the invention as described by the following claims.

What is claimed is:

1. An earth retaining wall, comprising;

at least two stacked tiers of blocks placed side by side to form a wall with a channel extending at least partially along a longitudinal axis of the wall, the channel defining a substantially triangular shape in tranverse cross-sectional view with at least two adjacent bearing surfaces and a pathway extending from the channel to exterior side of the wall;

an elongate connector bar, conforming in cross-sectional shape at least relative to the bearing surfaces, received within the channel; and a reinforcement sheet wrapped around the elongate connector bar and a portion thereof extending through the pathway laterally of the wall, whereby the connector bar, being wrapped by a portion of the reinforcement sheet and received in the channel with the reinforcement sheet extending laterally and a portion thereof loaded by backfill, mechanically engages the bearing surfaces of the channel to distribute the loading across the wall.

2. The earth retaining wall as recited in claim 1, wherein the connector defines a triangular shape in cross-sectional view.

3. The earth retaining wall as recited in claim 2, wherein the connector defines a second channel extending along a longitudinal axis thereof.

4. The earth retaining wall as recited in claim 2, wherein the pathway opens to the channel at an apex thereof.

5. The earth retaining wall as recited in claim 2, wherein the connector defines textured exterior surfaces.

6. The earth retaining wall as recited in claim 1, wherein the channel and the connector each define an equilateral triangle in cross-sectional view.

7. The earth retaining wall as recited in claim 6, wherein the connector defines a second channel extending along a longitudinal axis thereof.

8. The earth retaining wall as recited in claim 6, wherein the pathway defines arcuately tapered edge surfaces at the exterior side.

9. The earth retaining wall as recited in claim 6, wherein the pathway opens to the channel at an apex thereof.

10. The earth retaining wall as recited in claim 6, wherein the clamping bar defines textured exterior surfaces.

11. The earth retaining wall as recited in claim 1, wherein the pathway defines arcuately tapered edge surfaces at the exterior side.

12. The earth retaining wall as recited in claim 1, wherein the pathway opens to the channel at an apex thereof.

13. The earth retaining wall as recited in claim 1, wherein the connector defines textured exterior surfaces.

14. The earth retaining wall as recited in claim 1, wherein opposing upper and lower surfaces of the blocks define opposed mating surfaces for interlocking adjacent tiers of blocks.

15. The earth retaining wall as recited in claim 1, wherein the connector defines a second channel extending along a longitudinal axis thereof.

16. The earth retaining wall as recited in claim 1, wherein the channel is defined by vertically opposing blocks in the tiers of blocks with respective top and bottom surfaces of adjacent blocks defining the bearing surfaces, which blocks closely nest together while leaving the pathway therebetween through which the reinforcement sheet extends.

17. The earth retaining wall as recited in claim 16, wherein the connector defines a triangular shape in cross-sectional view.

18. The earth retaining wall as recited in claim 17, wherein the connector defines a second channel extending along a longitudinal axis thereof.

19. The earth retaining wall as recited in claim 17, wherein the pathway defines arcuately tapered edge surfaces at the exterior side.

20. The earth retaining wall as recited in claim 17, wherein the pathway opens to the channel at an apex thereof.

21. The earth retaining wall as recited in claim 17, wherein the connector defines textured exterior surfaces.

22. The earth retaining wall as recited in claim 16, wherein the connector defines an equilateral triangle in cross-sectional view.

23. The earth retaining wall as recited in claim 22, wherein the connector defines a second channel extending along a longitudinal axis thereof.

24. The earth retaining wall as recited in claim 22, wherein the pathway defines arcuately tapered edge surfaces at the exterior side.

25. The earth retaining wall as recited in claim 22, wherein the pathway opens to the channel at an apex thereof.

26. The earth retaining wall as recited in claim 22, wherein the connector defines textured exterior surfaces.

27. The earth retaining wall as recited in claim 16, wherein the pathway defines arcuately tapered edge surfaces at the exterior side.

28. The earth retaining wall as recited in claim 16, wherein the connector defines textured exterior surfaces.

29. The earth retaining wall as recited in claim 16, wherein opposing upper and lower surfaces of the blocks define opposed mating surfaces for engaging adjacent tiers of blocks.

30. The earth retaining wall as recited in claim 16, wherein the connector defines a second channel extending along a longitudinal axis thereof.

31. A method of constructing an earth retaining wall, comprising the steps of:

(a) placing first and second tiers of blocks side by side to define a length of a wall with a channel substantially triangular in shape in transverse cross-section extending at least partially along a longitudinal length thereof, the channel defining at least two bearing surfaces. and a pathway extending from the channel to an exterior side of the wall;

(b) wrapping a portion of a reinforcement sheet over a connector conforming in crosssectional shape at least relative to the two bearing surfaces;

(c) positioning the connector and the reinforcement sheet within the channel with a portion of the reinforcement sheet extending along the pathway laterally of the wall;

(d) covering the portion of the reinforcement sheet lateral of the wall with backfill, whereby the connector, being wrapped by the reinforcement sheet loaded by backfill, mechanically engages the two bearing surfaces of the channel such that the loading is distributed across the wall.

32. The method as recited in claim 31, wherein step (a) is accomplished by first placing the first tier of blocks and placing the second tier of blocks after step (c).

33. The method as recited in claim 31, further comprising the step of providing each block with opposing upper and lower surfaces with matingly engageable features for joining adjacent tiers of blocks.

34. The method as recited in claim 31, further comprising the step of providing a textured exterior surface to the connector.

35. A method of constructing an earth retaining wall, comprising the steps of:

(a) placing a first tier of blocks side by side to define a length of a wall, the blocks having upper surfaces that define a first bearing surface in a portion of a channel;

(b) positioning a connector wrapped with a portion of a reinforcement sheet on the upper surfaces of the blocks in the first tier with a portion of the reinforcement sheet extending laterally therefrom;

(c) placing a second tier of blocks side by side on the first tier, the blocks having lower surfaces that define a second bearing surface in a portion of the channel (d) covering the portion of the reinforcement sheet lateral of the wall with backfill, whereby the connector, being wrapped by the reinforcement sheet loaded by backfill, mechanically engages the two bearing surfaces of the channel such that the loading is distributed across the wall.

36. The method as recited in claim 35, further comprising the step of providing each block with opposing upper and lower surfaces with matingly engageable features for joining adjacent tiers of blocks.

37. The method as recited in claim 35, further comprising the step of providing a textured exterior surface to the connector.

38. A block for constructing an earth retaining wall formed of a plurality of the blocks placed side-by-side in tiers, comprising:

a body defined by two opposing sides, a top and an opposing bottom, and a front face and an opposing back face, the top of the body defining an open recess having opposed tapering sides extending to a base of the recess, and the bottom of the body defining a projection extending away from the body with opposed tapering sides, the depth of the channel exceeding the length of the projection from the body, whereby the channel of one such block receives the projection of another such block, thereby defining a channel through two aligned blocks for receiving a clamping bar therein, one of the opposing walls in the recess and a bottom wall of the bottom face defining bearing surfaces for engaging surfaces of the clamping bar, the adjacent blocks defining an pathway that extends from the channel outwardly of the blocks for receiving therein a portion of a reinforcement sheet, whereby the blocks, receiving the clamping bar wrapped with a portion of the reinforcement sheet that extends through the pathway laterally of the blocks, bear loading from the backfill covering the reinforcement sheet communicated by the clamping bar against the bearing surfaces.

39. The block as recited in claim 38, wherein the clamping bar defines a triangular shape in cross-sectional view.

40. The block as recited in claim 39, wherein the clamping bar defines a second channel extending along a longitudinal axis thereof.

41. The block as recited in claim 40, wherein the clamping bar defines textured exterior surfaces.

42. The block as recited in claim 38, wherein the clamping bar defines a second channel extending along a longitudinal axis thereof.

43. The block as recited in claim 38, wherein the clamping bar defines textured exterior surfaces.

44. The block as recited in claim 38, wherein opposing upper and lower surfaces of the blocks define opposed mating surfaces for engaging adjacent tiers of blocks.

45. An earth retaining wall, comprising:

at least two stacked tiers of blocks placed side by side to form a wall with a channel extending at least partially along a longitudinal axis of the wall, the channel defining at least two adjacent bearing surfaces and a pathway extending from the channel to an exterior side of the wall, the channel defined by vertically opposing blocks in the tiers of blocks with respective top and bottom surfaces of adjacent blocks defining the bearing surfaces, which blocks closely nest together while leaving the pathway therebetween through which the reinforcement sheet extends;

an elongate connector bar, conforming in cross-sectional shape at least relative to the bearing surfaces, received within the channel; and a reinforcement sheet wrapped around the elongate connector bar and a portion thereof extending through the pathway laterally of the wall, whereby the connector bar, being wrapped by a portion of the reinforcement sheet and received in the channel with the reinforcement sheet extending laterally and a portion thereof loaded by backfill, mechanically engages the bearing surfaces of the channel to distribute the loading across the wall.

46. The earth retaining wall as recited in claim 45, wherein the connector defines a triangular shape in cross-sectional view.

47. The earth retaining wall as recited in claim 46, wherein the connector defines a second channel extending along a longitudinal axis thereof.

48. The earth retaining wall as recited in claim 46, wherein the pathway defines arcuately tapered edge surfaces at the exterior side.

49. The earth retaining wall as recited in claim 46, wherein the pathway opens to the channel at an apex thereof.

50. The earth retaining wall as recited in claim 46, wherein the connector defines textured exterior surfaces.

51. The earth retaining wall as recited in claim 45, wherein the connector defines an equilateral triangle in cross-sectional view.

52. The earth retaining wall as recited in claim 51, wherein the connector defines a second channel extending along a longitudinal axis thereof.

53. The earth retaining wall as recited in claim 51, wherein the pathway defines arcuately tapered edge surfaces at the exterior side.

54. The earth retaining wall as recited in claim 51, wherein the pathway opens to the channel at an apex thereof.

55. The earth retaining wall as recited in claim 51, wherein the connector defines textured exterior surfaces.

56. The earth retaining wall as recited in claim 45, wherein the pathway defines arcuately tapered edge surfaces at the exterior side.

57. The earth retaining wall as recited in claim 45, wherein the connector defines textured exterior surfaces.

58. The earth retaining wall as recited in claim 45, wherein opposing upper and lower surfaces of the blocks define opposed mating surfaces for engaging adjacent tiers of blocks.

59. The earth retaining wall as recited in claim 45, wherein the connector defines a second channel extending along a longitudinal axis thereof.

60. A method of constructing an earth retaining wall, comprising the steps of:

(a) placing first and second tiers of blocks side by side to define a length of a wall with a channel extending at least partially along a longitudinal length thereof, the channel defining at least two bearing surfaces, and a pathway extending from the channel to an exterior side of the wall;

(b) wrapping a portion of a reinforcement sheet over a connector conforming in crosssectional shape at least relative to the two bearing surfaces, said connector provided with a textured exterior surface;

(c) positioning the connector and the reinforcement sheet within the channel with a portion of the reinforcement sheet extending along the pathway laterally of the wall;

(d) covering the portion of the reinforcement sheet lateral of the wall with backfill, whereby the connector, being wrapped by the reinforcement sheet loaded by backfill, mechanically engages the two bearing surfaces of the channel such that the loading is distributed across the wall.

61. The method as recited in claim 60, wherein step (a) is accomplished by first placing the first tier of blocks and placing the second tier of blocks after step (c).

62. The method as recited in claim 60, further comprising the step of providing each block with opposing upper and lower surfaces with matingly engageable features for joining adjacent tiers of blocks.

* * * * *

UNITED STATES PATENT AND TRADEMARK OFFICE

CERTIFICATE OF CORRECTION

PATENT NO. : 6,457,911 B1 
DATED : October 1, 2002
INVENTOR(S) : John M. Scales and Zehong Yaunl It is certified that error appears in the above-identified patent and that said Letters Patent is hereby corrected as shown below:

Column 7,
Line 17, after "to", insert -- an --.

Signed and Sealed this

Fourth Day of February, 2003

JAMES E. ROGAN
*Director of the United States Patent and Trademark Office*